US011031691B1

(12) United States Patent
Ding et al.

(10) Patent No.: US 11,031,691 B1
(45) Date of Patent: Jun. 8, 2021

(54) ULTRA-WIDEBAND WALL-MOUNTED ANTENNA

(71) Applicant: Kunshan Hamilton Communication Technology Co., Ltd, Jiangsu (CN)

(72) Inventors: Juntao Ding, Jiangsu (CN); Zhaoying Song, Jiangsu (CN); Jiexiang Wang, Jiangsu (CN); Wenkai Luo, Jiangsu (CN); Lu Zhang, Jiangsu (CN)

(73) Assignee: KUNSHAN HAMILTON COMMUNICATION TECHNOLOGY CO., LTD, Jiangsu (CN)

( * ) Notice: Subject to any disclaimer, the term of this patent is extended or adjusted under 35 U.S.C. 154(b) by 561 days.

(21) Appl. No.: 16/072,090

(22) PCT Filed: May 18, 2017

(86) PCT No.: PCT/CN2017/084824
§ 371 (c)(1),
(2) Date: Jul. 23, 2018

(87) PCT Pub. No.: WO2018/166062
PCT Pub. Date: Sep. 20, 2018

(30) Foreign Application Priority Data

Mar. 14, 2017 (CN) ..... 201710155066.1

(51) Int. Cl.
*H01Q 19/10* (2006.01)
*H01Q 5/25* (2015.01)
*H01Q 1/12* (2006.01)

(52) U.S. Cl.
CPC ..... *H01Q 5/25* (2015.01); *H01Q 1/1221* (2013.01); *H01Q 19/10* (2013.01)

(58) Field of Classification Search
CPC ..... H01Q 5/25; H01Q 19/10; H01Q 1/1221
See application file for complete search history.

(56) References Cited

U.S. PATENT DOCUMENTS 6,118,406 A * 9/2000 Josypenko ..... H01Q 1/38 343/700 MS
6,639,558 B2 * 10/2003 Kellerman ..... H01Q 9/0414 343/700 MS (Continued)

FOREIGN PATENT DOCUMENTS

CN 2672891 1/2005
CN 203071229 7/2013

(Continued)

*Primary Examiner* — Hoang V Nguyen
(74) *Attorney, Agent, or Firm* — Barnes & Thornburg LLP; Jeffrey R. Stone

(57) ABSTRACT

The present invention relates to an anchor point for e.g. lifting and/or lashing down an object. The anchor point comprises a base, which is configured for fixing to the object such that it is rotatable about an axis of rotation. The anchor point also comprises a retainer bracket held on two bearing points on the base such that it is tiltable about a tilt axis relative to the base. In order to prevent the retainer bracket from getting stuck when a force is applied thereto, which may lead to a sudden and jerky turnover of the retainer bracket or even to fracturing of the anchor point and crashing of the load, the tilt axis is movable relative to the base according to the present invention. Preferably, a motion link, for example, is provided on at least one bearing point.

10 Claims, 3 Drawing Sheets

(56) References Cited

U.S. PATENT DOCUMENTS

| | | | |
|---|---|---|---|
| 9,257,748 | B1 | 2/2016 | Lalezari et al. |
| 2014/0347243 | A1 | 11/2014 | Abadi et al. |

FOREIGN PATENT DOCUMENTS

| | | |
|---|---|---|
| CN | 205752547 | 11/2016 |
| CN | 205985354 | 2/2017 |

* cited by examiner

ULTRA-WIDEBAND WALL-MOUNTED ANTENNA

TECHNICAL FIELD

The present disclosure relates to the field of antenna technologies, for example, relates to an ultra-wideband wall-mounted antenna.

BACKGROUND

With the advent of 4G (the 4th generation mobile communication technology) and 5G (5th-Generation, the 5th generation mobile communication technology) communication era, data requests are getting larger and larger. The communication system bandwidth in the era of 3G (third generation, the 3th generation mobile communication technology) can no longer meet demands of future communications, and systems need higher bandwidth. In the meanwhile, a variety of antenna bandwidths are also needed to be widened. Operators urgently need an ultra-wideband wall-mounted antenna capable of covering 350M-2700M.

In the related art, an indoor coverage wall-mounted antenna covering a frequency band 698 to 2700 MHz (Million Hertz) basically adopt two design modes. One design mode is a wideband design. This technology adopts an ordinary half-wave oscillator plus an additional resonant unit. Although this technical approach can achieve a wideband, the radiation performance of the antenna is relatively poor, the high-frequency part of the beams is split, and there often exists a blind zone in coverage. The other one is frequency division design. The frequency band is divided into two main operation frequency bands 689-960 MHz/1710-2700 MHz, and a combiner is adopted to combine two antennas to one frequency band for usage. This technical approach has a good antenna coverage performance, but the cost is higher. At present, neither of the above two solutions can provide the indoor coverage antenna with an ultra-wideband of 350-3500 MHZ.

SUMMARY

To solve the above technical problem, embodiments of the present disclosure provide an ultra-wideband wall-mounted antenna to achieve low cost and ultra-wideband pattern directional coverage.

An embodiment of the present disclosure provides an ultra-wideband wall-mounted antenna. The ultra-wideband wall-mounted antenna includes a first element sheet, a second element sheet, a third element and a reflection board. Each of the first element sheet, the second element sheet, the third element and the reflection board is a flat surface. Both of the second element sheet and the third element sheet are disposed in parallel with the reflection board. The third element sheet is disposed between the second element sheet and the reflection sheet, and the first element sheet extends from an inner edge of the second element sheet onto a surface of the reflection board.

According to the ultra-wideband wall-mounted antenna provided by embodiments of the present disclosure, the first element sheet, the second element sheet and the third element are configured in a non-co-planar multi-layer structure, realizing a low cost and an ultra-wideband pattern directional coverage.

DETAILED DESCRIPTION

The present disclosure is described in detail below with reference to the accompanying drawings and embodiments. The following embodiments and features therein may be combined with each other without conflict.

First Embodiment

Figure 1:
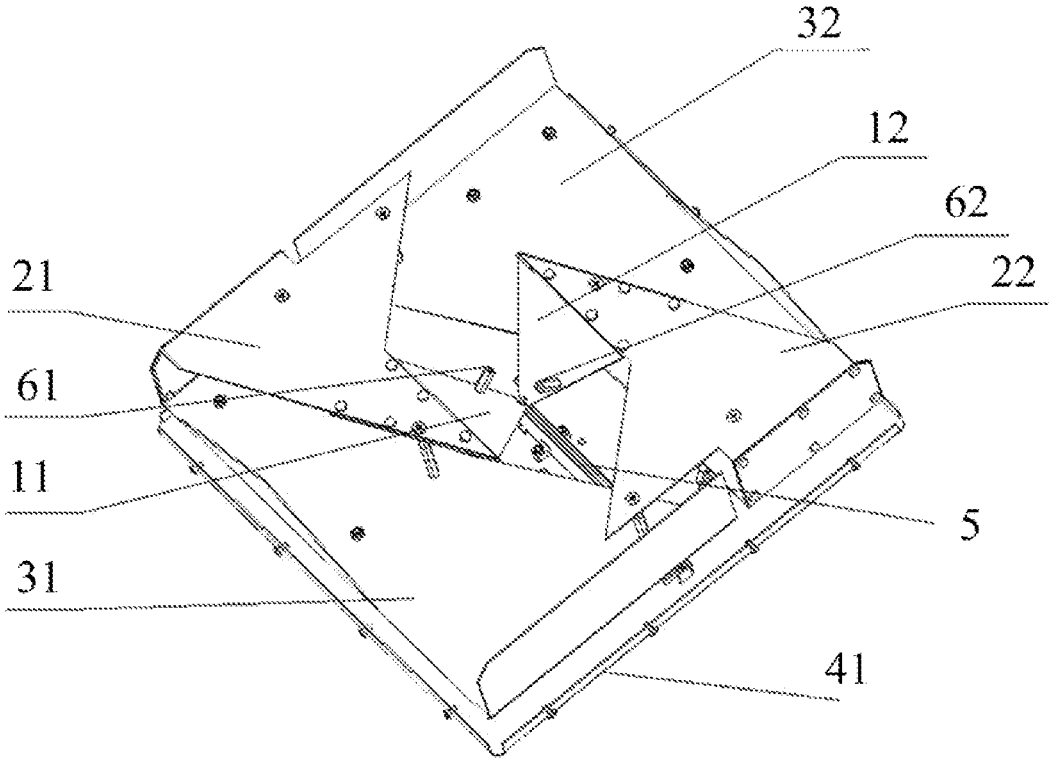
FIG. 1 is a perspective view of an ultra-wideband wall-mounted antenna provided by a first embodiment.

The present embodiment provides a technical solution of an ultra-wideband wall-mounted antenna. As shown in FIG. 1, the ultra-wideband wall-mounted antenna includes: a first element sheet (11, 12), a second element sheet (21, 22), a third element (31, 32), which are integrally formed, and a reflection board 41. Optionally, the first element sheet (11, 12), the second element sheet (21, 22), and the third element (31, 32) are sheet-shaped, and may be made from metal.

The reflection board 41 is disposed at the bottom of the entire ultra-wideband wall-mounted antenna, and is configured to reflect electromagnetic waves radiated thereon such that beams of the antenna are concentrated in one direction.

A matching component 5 is disposed on the reflection board 41. A function of the matching component 5 is to achieve impedance match between the element sheets and an antenna feeder. The matching component 5 is fixedly connected to the reflection board 41 by screws on the reflection board 41.

The second element sheet (21, 22) and the third element sheet (31, 32) are disposed in parallel with the reflection board 41 respectively. The first element sheet (11, 12), the second element sheet (21, 22), the third element (31, 32), and the reflection board 41 are all made of conductive material, and are configured to radiate electromagnetic waves.

Compared with the second element sheet (21, 22), the third element sheet (31, 32) is closer to the reflection board 41. The third element sheet includes a fifth element sub-sheet 31 and a sixth element sub-sheet 32. The fifth element sub-sheet 31 and the sixth element sub-sheet 32 are axis-symmetric about a central normal line of the reflection board 41.

The fifth element sub-sheet 31 and the sixth element sub-sheet 32 have relatively larger surface areas. In order to ensure the firm connections of the above two element sub-sheets, the fifth element sub-sheet 31 and the sixth element sub-sheet 32 are secured to the reflection board 41 by screws at the central positions of the fifth element sub-sheet 31 and the sixth element sub-sheet 32. A height of the fifth element sub-sheet 31 from the reflection board 41 should be equal to a height of the sixth element sub-sheet 32 from the reflection board 41. Moreover, the height of the fifth element sub-sheet 31 from the reflection board 41 and the height of the sixth element sub-sheet 32 from the reflection board 41 should be greater than a own height of the matching component 5.

Similar to the third element sheet (31, 32), the second element sheet (21, 22) also includes two element sub-sheets which are axis-symmetric about the central normal line of the reflection board 41. The two element sub-sheets are referred to as a third element sub-sheet 21 and a fourth element sub-sheet 22 respectively. Compared with the fifth element sub-sheet 31 and the sixth element sub-sheet 32, the surface areas of the third element sub-sheet 21 and the fourth element sub-sheet 22 are relatively smaller. Due to the smaller surface areas, compared with the fifth element sub-sheet 31 and the sixth element sub-sheet 32, fewer the firm connection points where screws are used are provided on the third element sub-sheet 21 and the fourth element sub-sheet 22.

The first element sheet (11, 12) is composed of two element sub-sheets arranged in an inverted truncated chevron shape. The two element sub-sheets are referred to as a first element sub-sheet 11 and a second element sub-sheet 12. As the same as the second element sheet and the third element sheet, the two element sub-sheets constituting the first element sheets, that is, the first element sub-sheet 11 and the second element sub-sheet 12 are also axis-symmetric about the central normal line of the reflection board 41.

An upper edge of the first element sub-sheet 11 is fixedly connected to a first side edge of the third element sub-sheet 21. The first element sub-sheet 11 goes downward obliquely from the first side edge of the third element sub-sheet 21 and extends to one end of the matching component 5. That is to say, a first end of the element sub-sheet 11 opposite to the upper edge is in contact with the one end of the matching component 5.

Correspondingly, the upper edge of the second element sub-sheet 12 is fixedly connected to a first side edge of the fourth element sub-sheet 22. The second element sub-sheet 12 is inclined downward from the first side edge of the fourth element sub-sheet 22 and extends to an end portion of the matching component 5.

Since the two element sub-sheets constituting the first element sheet (11, 12) have the above structure matching, a bell-mouth structure is formed by the reflection board 41 and the first element sheet (11, 12). Due to such a bell-mouth structure configuration, it is significantly beneficial to improve antenna gain.

The first element sub-sheet 11 is provided with a first columnar regulator 61, and the second element sub-sheet 12 is provided with a second columnar regulator 62. The functions of the two columnar regulators (the first columnar regulator 61 and the second columnar regulator 62) are to adjust standing waves of the first element sub-sheet 11 and the second element sub-sheet 12. In operating frequency bands of the above two element sub-sheets, the current has maximum points at the two columnar regulators 61 and 62, and wave peaks of the standing waves are formed. With configuration of the columnar regulators 61 and 62, a part of the current flows to the columnar regulators 61 and 62 to reduce the energy reflection therein, such that an objective of improving the standing waves is achieved. Different bands may be adjusted when setting the columnar regulators 61, 62 on different positions of the first element sub-sheet 11 and the second element sub-sheet 12. The columnar regulators 61, 62 may also be sheet-shaped.

Figure 2:
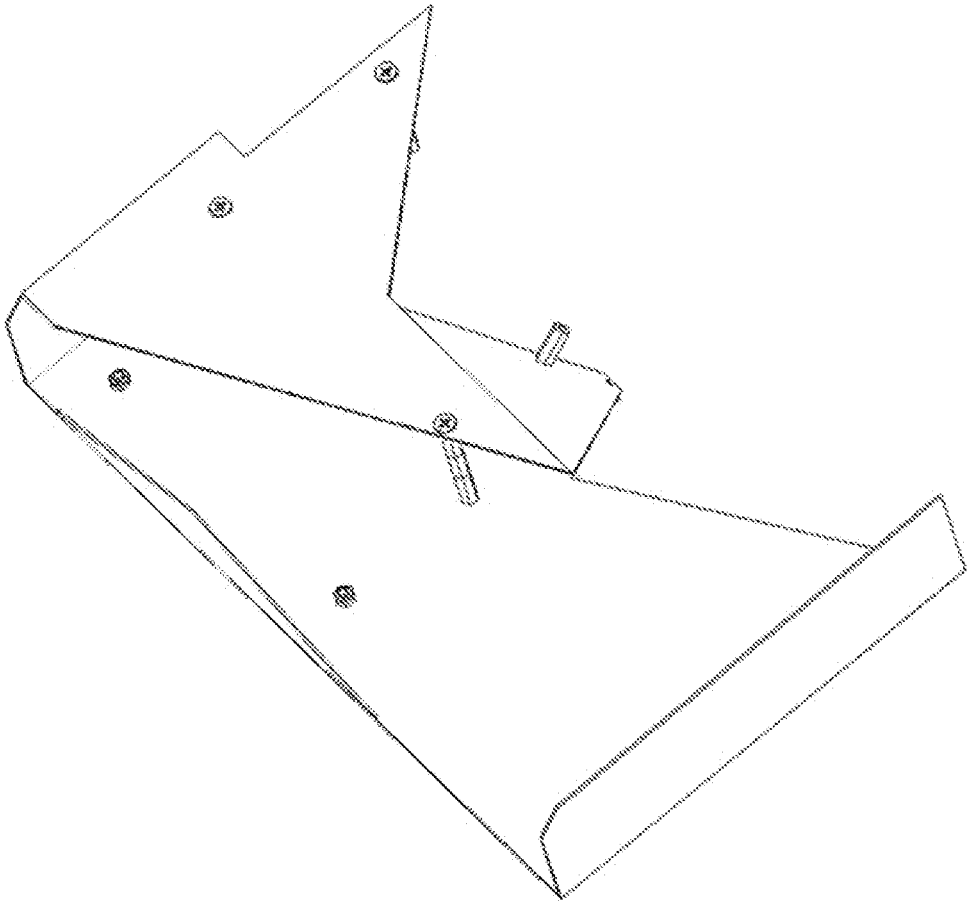
FIG. 2 is a partial perspective view of the ultra-wideband wall-mounted antenna provided by the first embodiment.

In the present embodiment, the first element sheet (11, 12), the second element sheet (21, 22), and the third element sheet (31, 32) are all integrally formed. Fastening parts such as screws and studs used therebetween are for the purpose of partial reinforcement, but do not indicate the above components are separated components. FIG. 2 is a partial perspective view of the ultra-wideband wall-mounted antenna provided by the embodiment. As shown in FIG. 2, there is no gap among the multiple components shown in the figure, that is, the multiple components are integrally formed.

The first element sheet mainly implements the frequency coverage of a frequency band from 1.7 GHz to 3.5 GHz. The second element sheet mainly implements the frequency coverage of a frequency band from 0.7 GHz to 1.7 GHz. The third element sheet implements the frequency coverage of a frequency band from 0.35 GHz to 0.7 GHz.

It should be noted that, the couplings among the first element sheet (11, 12), the second element sheet (21, 22), and the third element sheet (31, 32) are all capacitive couplings. Adopting the capacitive couplings can avoid generation of passive intermodulation between different element sheets.

In the ultra-wideband wall-mounted antenna provided by the present embodiment, a multi-layer non-coplanar structure is adopted, which is completely beneficial for improving space utilization and making the antenna itself more compact.

In the present embodiment, the first element sheet, the second element sheet and the third element are configured in the multi-layer non-coplanar structure, realizing a low cost and an ultra-wideband radiation pattern directional coverage.

Second Embodiment

Figure 3:
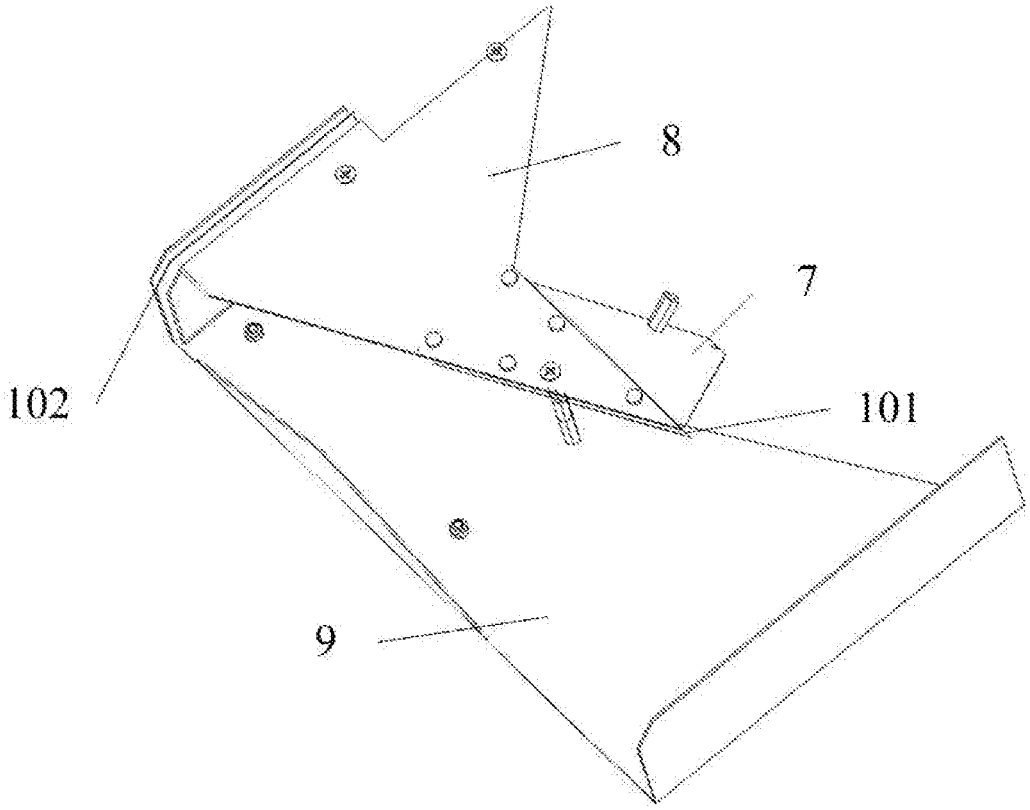
FIG. 3 is a partial perspective view of an ultra-wideband wall-mounted antenna provided by a second embodiment.

The embodiment provides another technical solution of the ultra-wideband wall-mounted antenna. As shown in FIG. 3, the ultra-wideband wall-mounted antenna in the embodiment includes: a first element sheet 7, a second element sheet 8 and a third element sheet 9 which are formed separately, and a reflection board 41 (not shown in FIG. 3, but refer to FIG. 1).

In addition to the separate formations, the difference between the second embodiment and the first embodiment in that: a first coupling sheet 101 is provided below the second element sheet 8, and a second coupling sheet 102 is further provided between an edge of the second element sheet 8 and the third element sheet 9. A function of the first coupling sheet 101 is to adjust the coupling between the second element sheet 8 and the first element sheet 7 to be the capacitive coupling. A function of the second coupling sheet 102 is to adjust the coupling between the second element sheet 8 and the third element sheet 9 to be the capacitive coupling.

INDUSTRIAL APPLICABILITY

According to the ultra-wideband wall-mounted antenna provided by embodiments of the present disclosure, the first element sheet, the second element sheet and the third element are configured in a multi-layer non-coplanar structure, which realizes a low cost and an ultra-wideband radiation pattern directional coverage.

What is claimed is:

1. An ultra-wideband wall-mounted antenna, comprising: a first element sheet, a second element sheet, a third element sheet and a reflection board, wherein each of the first element sheet, the second element sheet, the third element sheet and the reflection board is a flat surface, both of the second element sheet and the third element sheet are disposed in parallel with the reflection board, the third element sheet is disposed between the second element sheet and the reflection board, and the first element sheet extends from an inner edge of the second element sheet onto a surface of the reflection board.

2. The ultra-wideband wall-mounted antenna according to claim 1, wherein each of the first element sheet, the second element sheet and the third element sheet comprises two element sub-sheets which are axis-symmetric about a central normal line of the reflection board.

3. The ultra-wideband wall-mounted antenna according to claim 2, wherein the first element sheet, the second element sheet and the third element sheet are integrally formed.

4. The ultra-wideband wall-mounted antenna according to claim 3, further comprising a matching component disposed on the reflection board and configured to matching a feeder cable.

5. The ultra-wideband wall-mounted antenna according to claim 4, further comprising columnar regulators disposed on the two element sub-sheets of the first element sheet respectively.

6. The ultra-wideband wall-mounted antenna according to claim 2, wherein the first element sheet, the second element sheet and the third element sheet are independently formed respectively, and are connected with each other by screws in a fixed manner.

7. The ultra-wideband wall-mounted antenna according to claim 6, further comprising:

a first coupling sheet disposed at a side of the second element sheet close to the third element sheet and configured to couple the second element sheet and the first element sheet, and a second coupling sheet disposed at an edge of the second element sheet, located between the edge of the second element sheet and the third element sheet, and configured to couple the second element sheet and the third element sheet.

8. The ultra-wideband wall-mounted antenna according to claim 7, wherein the first coupling sheet capacitively couples the first element sheet and the second element sheet, and the second coupling sheet capacitively couples the second element sheet and the third element sheet.

9. The ultra-wideband wall-mounted antenna according to claim 8, further comprising a matching component disposed on the reflection board and configured to matching a feeder cable.

10. The ultra-wideband wall-mounted antenna according to claim 9, further comprising columnar regulators disposed on the two element sub-sheets of the first element sheet respectively.

* * * * *